US007370600B2

(12) United States Patent
Tomassetti et al.

(10) Patent No.: US 7,370,600 B2
(45) Date of Patent: May 13, 2008

(54) AIR HORN WITH LIGHT SIGNAL

(76) Inventors: Louis Tomassetti, 2745 W. Atlantic Blvd., #300, Pompano Beach, FL (US) 33062; Peter Tomassetti, 2745 W. Atlantic Blvd., #300, Pompano Beach, FL (US) 33062

( * ) Notice: Subject to any disclaimer, the term of this patent is extended or adjusted under 35 U.S.C. 154(b) by 0 days.

(21) Appl. No.: 11/318,133

(22) Filed: Dec. 23, 2005

(65) Prior Publication Data

US 2006/0137595 A1 Jun. 29, 2006

Related U.S. Application Data

(60) Provisional application No. 60/639,376, filed on Dec. 24, 2004.

(51) Int. Cl.
*G08B 7/00* (2006.01)
*G10K 9/04* (2006.01)

(52) U.S. Cl. ..... 116/3; 116/137 R; 116/142 FP; 116/DIG. 44; 222/39; 340/404.1; 340/321; 362/86; 362/383

(58) Field of Classification Search ..... 116/137 R, 116/142 FP, DIG. 1, DIG. 44, 24, 3, 2, 4, 116/5, 6, 7, 112, 202, DIG. 7, 139; 340/321, 340/326, 328, 331, 384.1, 388.1, 391.1, 404.1, 340/815.4, 815.65; 362/86, 383, 276, 802, 362/96, 154, 186, 190
See application file for complete search history.

(56) References Cited

U.S. PATENT DOCUMENTS 780,491 A * 1/1905 Bert ..... 116/3
1,134,360 A * 4/1915 Walker ..... 116/3
1,137,239 A * 4/1915 Sparks ..... 116/137 R
1,168,440 A * 1/1916 Thompson ..... 116/3
1,185,740 A * 6/1916 Wales ..... 116/3
1,200,554 A * 10/1916 Wales ..... 116/DIG. 1
1,290,728 A * 1/1919 Fanger ..... 116/137 R
1,349,063 A * 8/1920 Gordon et al. ..... 116/3
2,782,748 A * 2/1957 Zegarowitz ..... 116/112
2,893,344 A * 7/1959 Meyers ..... 116/DIG. 44

(Continued)

FOREIGN PATENT DOCUMENTS

JP 01264103 A * 10/1989

*Primary Examiner*—Richard Smith
*Assistant Examiner*—Amy Cohen Johnson
(74) *Attorney, Agent, or Firm*—Robert M. Downey, PA

(57) ABSTRACT

A horn device includes a trumpet fixture which removably attaches to the valve portion of a canister containing a charge of compressed air. An actuator button on the trumpet fixture is operable to open the valve assembly of the canister causing release of the pressurized air through the trumpet fixture to produce a loud horn noise. One or more light signal lamps are provided on the trumpet fixture. In a preferred embodiment, the light signal lamps are powered by one or more batteries carried on the trumpet fixture. In a further embodiment, a light emitting lamp on the rear facing end of the trumpet fixture is covered with a split color lens, having a green half and a red half to provide auxiliary running lights of a water vessel. In still a further embodiment, the light emitting lamp is provided in a light signaling device which is hingedly attached to the trumpet fixture. Control buttons allow selective activation of the light signal lamps in one or more modes of operation (e.g. steady, flash, flash sequence).

14 Claims, 4 Drawing Sheets

U.S. PATENT DOCUMENTS 2,966,877 A * 1/1961 Konold et al. ..... 116/137 R
3,670,690 A * 6/1972 Swanson ..... 116/DIG. 44
3,794,791 A * 2/1974 Thomson ..... 200/61.93
4,247,844 A * 1/1981 Zapolski et al. ..... 340/321
4,716,402 A * 12/1987 Francis ..... 340/546
5,075,671 A * 12/1991 Livingston, III ..... 116/142 FP
5,086,377 A * 2/1992 Roberts ..... 362/102
5,124,898 A * 6/1992 Chabria ..... 362/253
5,420,766 A * 5/1995 Hollis ..... 362/96
5,556,003 A * 9/1996 Johnson et al. ..... 222/39
5,588,735 A * 12/1996 Harada ..... 362/102
5,683,168 A * 11/1997 Teig et al. ..... 362/96
5,816,688 A * 10/1998 Shui-Shang ..... 362/253
5,940,014 A * 8/1999 Hartt ..... 340/953
5,941,629 A * 8/1999 Tuscher ..... 362/253
5,949,338 A * 9/1999 Masi et al. ..... 340/573.1
7,121,432 B2 * 10/2006 Kostal et al. ..... 222/192
2006/0090783 A1 * 5/2006 King-Fai ..... 135/67
2007/0272144 A1 * 11/2007 Tomassetti et al. ..... 116/3

* cited by examiner

AIR HORN WITH LIGHT SIGNAL

This application is based on provisional patent application Ser. No. 60/639,376 filed on Dec. 24, 2004 for which applicant claims the benefit under Title 35, United States Code section 119 (e).

BACKGROUND OF THE INVENTION

1. Field of the Invention

The present invention is directed to portable air horn devices which operate on compressed air and, more particularly, to a hand held, self-contained air horn device which includes a trumpet fixture attached to the valve structure of a compressed air canister and one or more light emitting signaling devices on the trumpet fixture.

2. Discussion of the Related Art

Hand held air horn devices of the type which operate with use of compressed air released from a canister are well known in the art. Air horns of this type normally have a trumpet fixture which includes an actuator button and a cone-shaped trumpet nozzle which is configured to produce a loud horn blast when air is released from the canister and through the trumpet fixture and outwardly from the conical trumpet nozzle. Air horn devices of this type are used extensively in the marine industry as navigational aids, often as one of several mandatory items required by U.S. Coast Guard regulations. Hand held compressed air operated horns are also found at numerous sporting events for signaling by both officials during a particular event, as well as fans.

Heretofore, hand held compressed air operated air horns have typically comprised just a noise producing trumpet fixture attached to a canister. In many instances, there is a need for a light signaling device for use in conjunction with a horn signaling device. Specifically, in the marine industry, it is often necessary to signal with lights, particularly at night to indicate direction of movement of a vessel, as well as to a distress signal in an emergency. Additionally, light signals, such as flashing lights, are useful as a roadside emergency signaling means. Moreover, the combination of flashing and or steady lights on an air horn may enhance the overall usefulness of the air horn in various situations, both for signaling purposes as well as at festive activities.

Accordingly, there remains a need in the art for a hand held air horn device which includes a trumpet fixture removably attachable to the valve structure of a compressed air canister, and further wherein the trumpet fixture includes one or more light signaling devices.

SUMMARY OF THE INVENTION

The present invention is directed to an horn device that includes a trumpet fixture which removably attaches to the valve portion of a canister containing a charge of compressed air. An actuator button on the trumpet fixture is operable to open the valve assembly of the canister, causing release of the pressurized air through the trumpet fixture to produce a loud horn noise. The trumpet fixture is provided with one or more light signal lamps. In a preferred embodiment, the light signal lamps are powered by one or more batteries carried on the trumpet fixture. In a further embodiment, a light emitting lamp on the rear facing end of the trumpet fixture is covered with a split color lens, having a green half and a red half to provide auxiliary navigational running lights of a water vessel. In still a further embodiment, the light emitting lamp is provided in a light signaling device which is hingedly attached to the trumpet fixture.

Control buttons allow selective activation of the light signal lamps in one or more modes of operation (e.g. steady, flash, flash sequence).

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
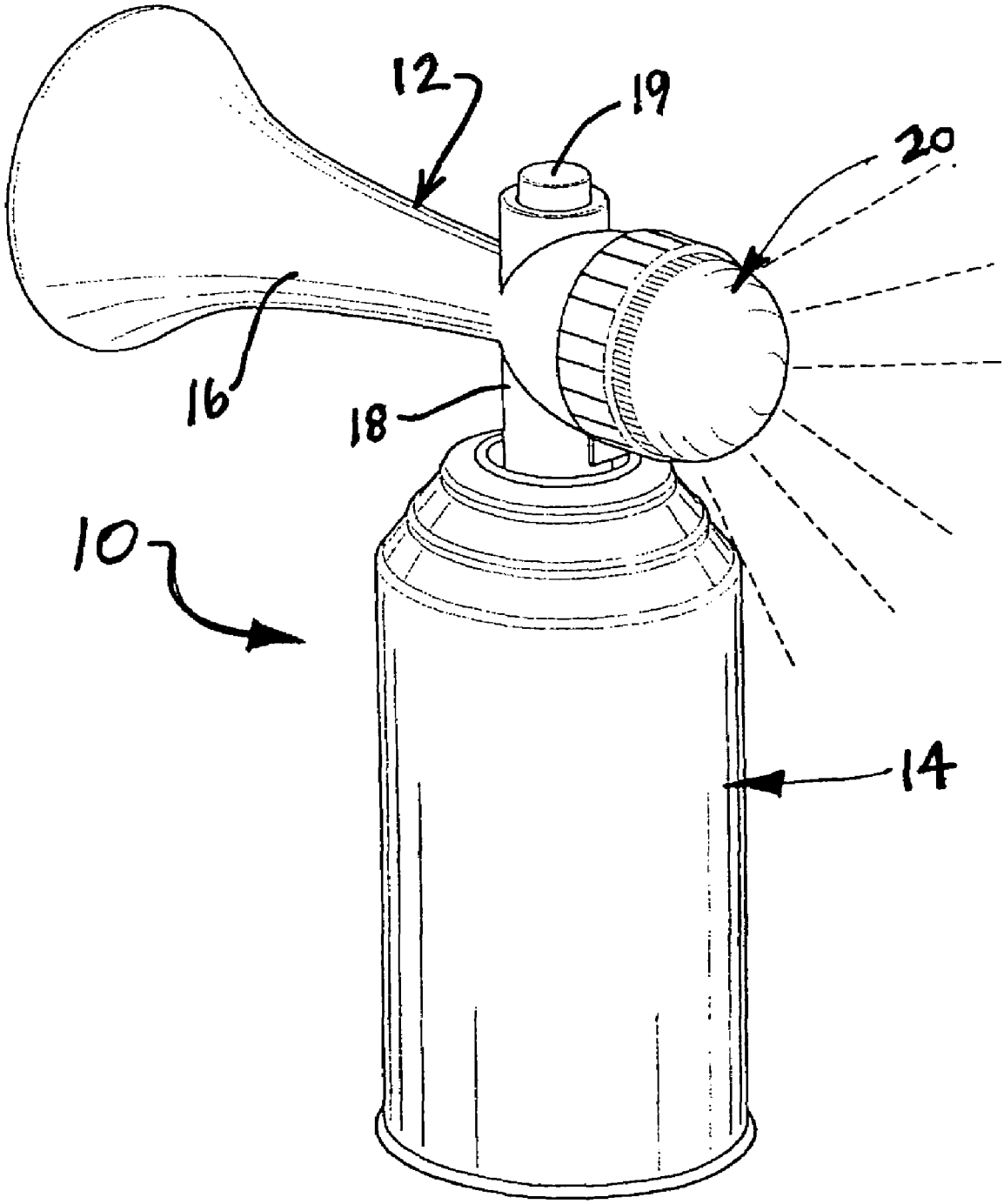
FIG. 1 is a side, rear perspective view of the air horn with light signal of the present invention shown in accordance with one preferred embodiment thereof.
Figure 2:
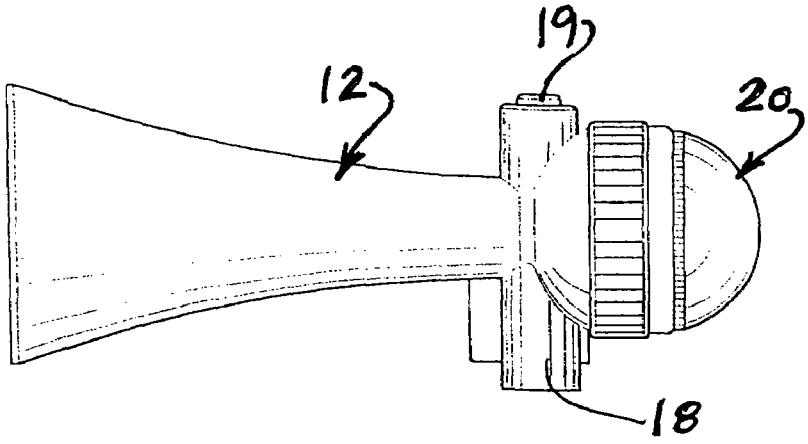
FIG. 2 is a side elevational view of the trumpet fixture of the embodiment of FIG. 1 showing a light emitting signal on the rear of the trumpet fixture.

Referring to the several views of the drawings, and initially FIG. 1, the air horn device of the present invention is shown and is generally indicated as 10. The air horn includes a trumpet fixture 12 which removably attaches, by screw thread engagement, to a top nozzle fitting on canister 14. The canister 14 is filled with a charge of pressurized air. A trumpet nozzle 16 extends out from an actuator section 18 having an actuator button 19 on the top. Operation of the actuator button 19 serves to open the valve fitting on the canister 14, thereby releasing pressurized air through the actuator portion 18 and outwardly through the trumpet nozzle 16, creating a loud horn noise.

Figure 3:
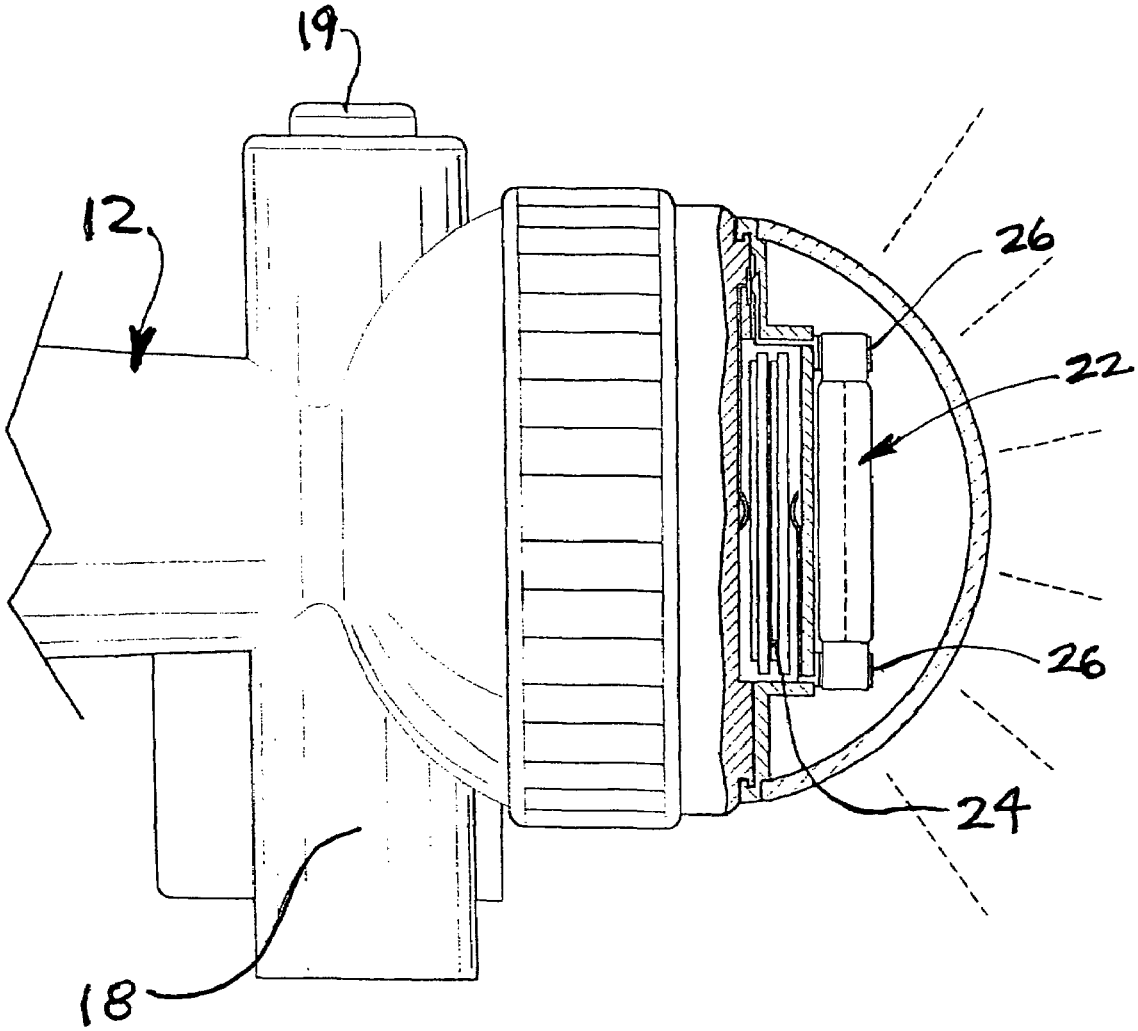
FIG. 3 is an isolated side elevational view of the rear portion of the trumpet fixture, taken in partial cross-section.

In each of the embodiments shown and described hereinafter, the horn device is provided with at least one light signal on the trumpet fixture 12. Referring initially to FIG. 1, a light signal 20 is provided on the rear facing end of the trumpet fixture 12. As seen in FIG. 3, an electric light emitting lamp 22 is fitted within a socket and in electric communication with the batteries 24 for energizing the lamp 22 when the circuit between the batteries and socket 26 is closed at both the positive and negative terminals. Closing of the circuit is achieved by rotating the housing of the light signal 20 until contacts on the light housing align with contacts on the rear side of the trumpet fixture housing.

Figure 4:
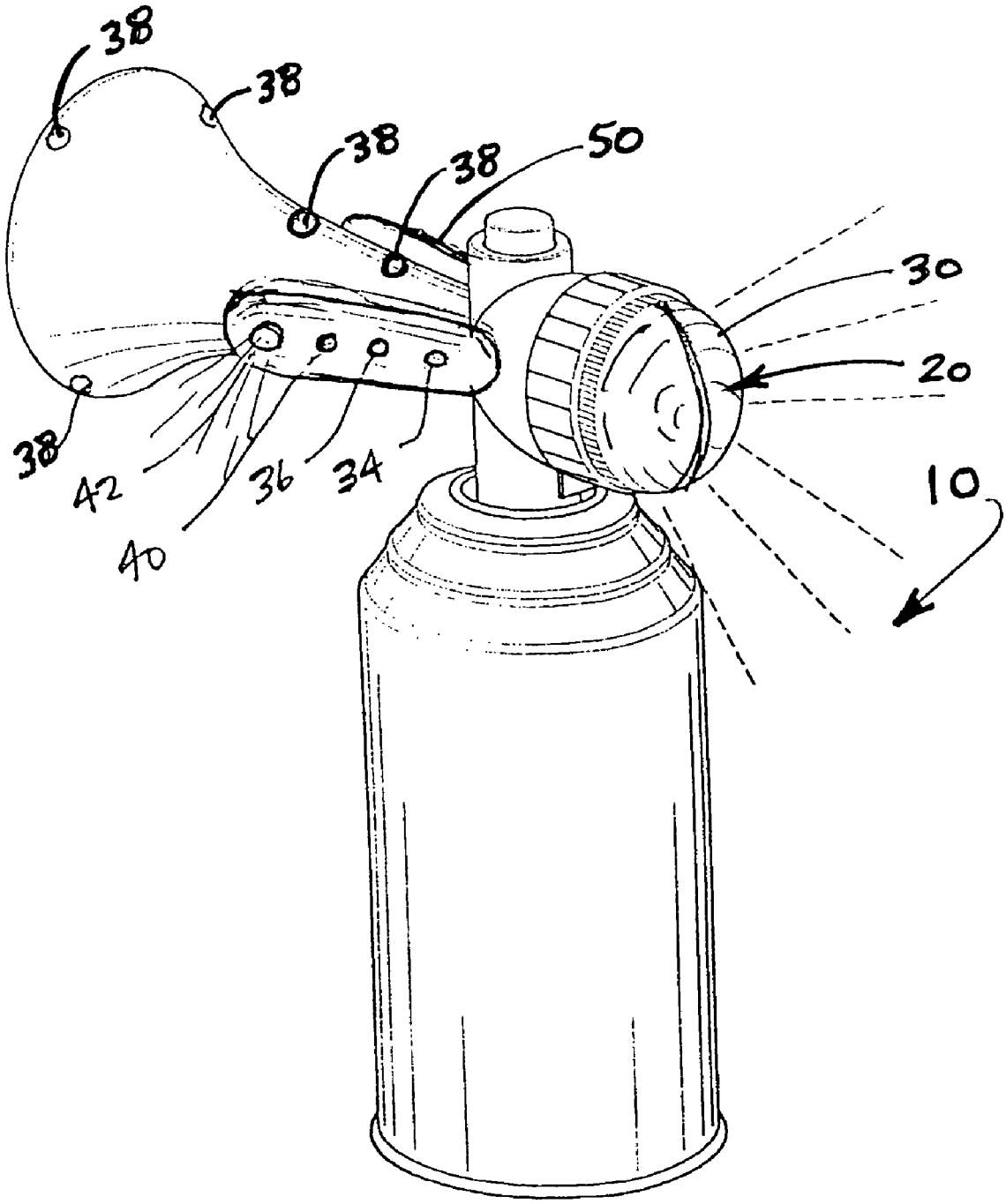
FIG. 4 is a side, rear perspective view illustrating a further embodiment of the present invention.

Referring to FIG. 4, a further embodiment of the present invention is shown wherein the light signal on the rear end of the trumpet fixture includes a multi-color lens cover 30. In this embodiment, the split color lens cover 30 may include a red half and a green half which provide auxiliary navigational running lights of a water vessel. This allows the user to hold the horn device 10 in the opposite facing direction so that the lens cover 30 is facing the bow of the vessel. While holding the horn device in this position, the lamp 22 may be activated causing red and green light to be emitted in the direction corresponding with the port and starboard side of the vessel. Controls are provided on the side of the trumpet fixture for activating the various lights on the device. Specifically, a first button 34 activates the navigation lights on the rear of the trumpet fixture. A second button 36 activates one or more bulbs fixed to the inside or outside of the trumpet nozzle. For instance, light emitting bulbs 38 maybe positioned at various locations on the nozzle, either on the inside and/or the outside. The bulbs may be operated in either a flash sequence or a steady illuminated sequence. Finally, a control button 40 is provided for activating a side light beam 42 which serves as a small flashlight to locate items in the dark. A battery pack 50 is provided on the opposite side of the trumpet for providing power to the various light emitting signals.

Figure 5:
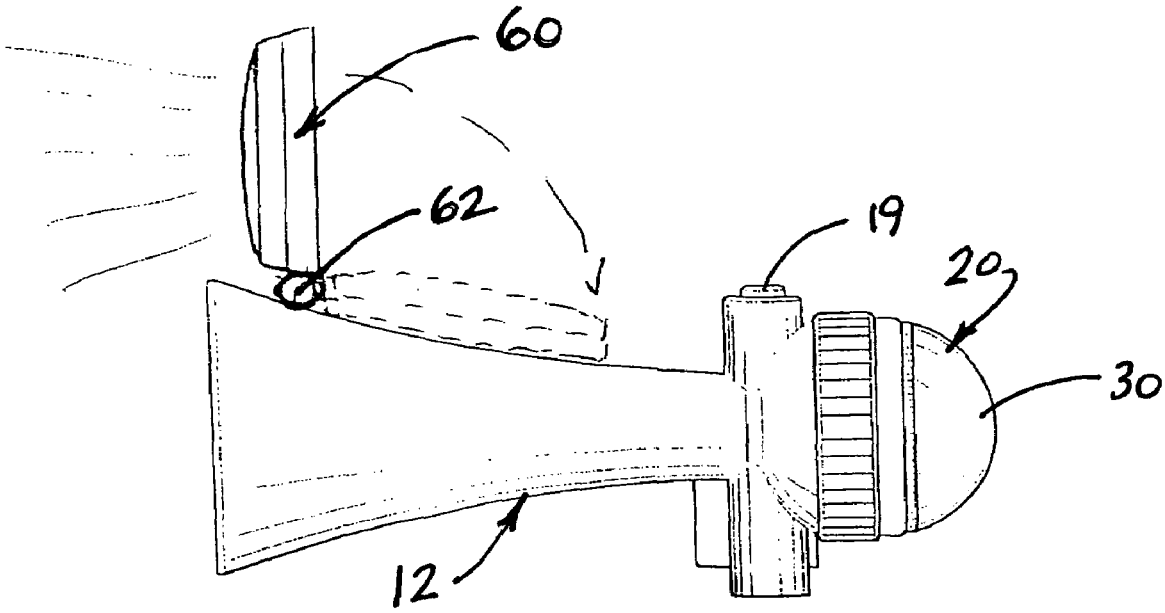
FIG. 5 is a side elevational view of the trumpet fixture with a hinged light signal thereon, in accordance with yet a further embodiment of the present invention.

Referring to FIG. 5, the trumpet fixture is shown to include a folding light signal 60 which is hinged at 62 to allow operation of the light signal 60 between a collapsed position and a raised position. In the raised position, as shown in FIG. 5, the light emitted from the device 60 is directed in the forward direction, which is the same direction as the sound emitted from the trumpet nozzle. Controls (e.g. push buttons) and batteries for activating the lamp in the device 60 may be provided on the rear side of the light signal device.

While the instant invention has been shown and described in accordance with a preferred and practical embodiment thereof, it is recognized that departures from the instant disclosure are contemplated within the spirit and scope of the present invention.

What is claimed is:

1. A horn device comprising:

a canister adapted to hold a charge of pressurized gas and including a valve member that is operable to an open position to release a flow of the pressurized gas upon actuation thereof;

a trumpet fixture structured for removable attachment to a top of said canister in airflow communication with said valve member, said trumpet fixture including an actuator fitted thereon, and said actuator being operable to open said valve member to cause the released pressurized gas to flow through said trumpet fixture and produce a loud horn noise;

said trumpet fixture further including a compartment on a rear of said trumpet fixture containing at least one light emitting lamp and a battery power source for energizing said at least one light emitting lamp in order to illuminate said at least one light emitting lamp; and at least one switch control on said trumpet fixture for controlling illumination of said at least one light emitting lamp.

2. The horn device as recited in claim 1 wherein said at least one light emitting lamp is on an outside of said trumpet fixture.

3. The horn device as recited in claim 1 further including at least one light emitting lamp on an inside of said trumpet fixture.

4. The horn device as recited in claim 1 further including at least one light emitting lamp is positioned and disposed to direct light in a forward direction relative to the trumpet fixture.

5. The horn device as recited in claim 1 further including a multi-color lens cover over said compartment on the rear of said trumpet fixture and said at least one light emitting lamp for producing multiple colors of light directed out from the multi-color lens cover.

6. The horn device as recited in claim 5 wherein said multi-color lens cover includes a red half and a green half for providing auxiliary navigational running lights of a water vessel.

7. The horn device as recited in claim 6 wherein said multi-color lens cover has a semi-spherical dome shape.

8. The horn device as recited in claim 1 wherein said at least one light emitting lamp is operable in a steady illuminating mode.

9. The horn device as recited in claim 1 wherein said at least one light emitting lamp is operable in a flashing mode.

10. The horn device as recited in claim 1 wherein said at least one light emitting lamp is operable in a flash sequence mode.

11. The horn device as recited in claim 10 wherein said flash sequence mode is a distress signal.

12. The horn device as recited in claim 1 wherein said trumpet fixture includes a plurality of said light emitting lamps.

13. A horn device comprising:

a canister adapted to hold a charge of pressurized gas and including a valve member that is operable to an open position to release a flow of the pressurized gas upon actuation thereof;

a trumpet fixture structured for removable attachment to a top of said canister in airflow communication with said valve member, said trumpet fixture including an actuator fitted thereon, and said actuator being operable to open said valve member to cause the released pressurized gas to flow through said trumpet fixture and produce a loud horn noise;

said trumpet fixture further including at least one light emitting lamp in a rear compartment of said trumpet fixture and a lens cover over said at least one light emitting lamp; and at least one switch control on said trumpet fixture for controlling illumination of said at least one light emitting lamp.

14. A hand-held horn device comprising:

a canister adapted to hold a charge of pressurized gas and including a valve member that is operable to an open position to release a flow of the pressurized gas upon actuation thereof;

a trumpet fixture structured for removable attachment to a top of said canister in airflow communication with said valve member, said trumpet fixture including a hand operated actuator fitted thereon, and said hand operated actuator being operable to open said valve member to cause the released pressurized gas to flow through said trumpet fixture and produce a loud horn noise;

said trumpet fixture further including at least one light emitting lamp in a rear compartment of said trumpet fixture and a semi-spherical dome shaped lens cover over said at least one light emitting lamp; and at least one switch control on said trumpet fixture for controlling illumination of said at least one light emitting lamp.

* * * * *